US011439251B2

(12) United States Patent
Patel

(10) Patent No.: US 11,439,251 B2
(45) Date of Patent: Sep. 13, 2022

(54) BABY SLEEPING APPARATUS

(71) Applicant: Rohan Patel, Bensalem, PA (US)

(72) Inventor: Rohan Patel, Bensalem, PA (US)

( * ) Notice: Subject to any disclaimer, the term of this patent is extended or adjusted under 35 U.S.C. 154(b) by 127 days.

(21) Appl. No.: 16/137,608

(22) Filed: Sep. 21, 2018

(65) Prior Publication Data

US 2019/0104861 A1 Apr. 11, 2019

Related U.S. Application Data

(60) Provisional application No. 62/562,233, filed on Sep. 22, 2017.

(51) Int. Cl.
*A47D 9/02* (2006.01)
*A47D 15/00* (2006.01)

(52) U.S. Cl.
CPC ..... *A47D 9/02* (2013.01); *A47D 15/00* (2013.01)

(58) Field of Classification Search
CPC ..... A47D 9/02; A47D 15/00; A47D 15/005; A47D 15/008
See application file for complete search history.

(56) References Cited

U.S. PATENT DOCUMENTS 4,862,534 A * 9/1989 Gomez-Marcial ... A47C 29/006 5/97
4,946,221 A * 8/1990 Livingston ..... A47D 15/00 297/184.13
5,113,537 A * 5/1992 Turk ..... A45F 3/22 135/90
6,056,355 A * 5/2000 Klassen ..... A47D 15/00 297/184.1
6,109,280 A * 8/2000 Custer ..... A47C 29/006 135/116
6,339,304 B1 * 1/2002 Allison ..... A47D 13/105 318/443
6,386,986 B1 * 5/2002 Sonner ..... A47D 9/02 297/273
6,467,107 B1 * 10/2002 Glover ..... A47C 7/66 135/125
7,685,657 B1 * 3/2010 Hernandez ..... A47D 9/02 5/109
8,087,110 B1 * 1/2012 Park ..... A47C 29/006 5/414
8,684,856 B2 * 4/2014 Pyrce ..... A47D 9/02 472/119
8,746,794 B2 * 6/2014 Oren ..... A47D 11/005 297/274
8,777,311 B1 * 7/2014 Laurel, Jr. ..... A47D 1/00 297/217.3

(Continued)

OTHER PUBLICATIONS

Ariel Swift, "Graco Dream Glider, Ariel does a quick product overview", Jul. 30, 2017, YouTube, available at https://www.youtube.com/watch?v=MQjquVvxQ3A (Year: 2017).*

(Continued)

*Primary Examiner* — Joshua T Kennedy

(57) ABSTRACT

This new baby bed allows parents to easily access baby from the bed with almost 3 sides being available to access baby from. Also, while a baby is sleeping in the bed, the bed should be secured so the baby cannot crawl out of it, and so forth. In addition, a bed must be able to secure a baby in a convenient way while allowing sufficient movement for the baby.

22 Claims, 14 Drawing Sheets

(56) References Cited

U.S. PATENT DOCUMENTS

| | | | | |
|---|---|---|---|---|
| 8,845,440 | B2 * | 9/2014 | Haut | A47D 13/10 472/119 |
| 8,931,839 | B1 * | 1/2015 | Laurel, Jr. | A47D 1/00 297/217.3 |
| 9,279,486 | B2 * | 3/2016 | Wu | A47D 9/04 |
| 9,392,880 | B2 * | 7/2016 | Do | A47D 7/002 |
| 9,629,476 | B1 * | 4/2017 | Robbins | A47D 13/105 |
| 10,016,068 | B2 * | 7/2018 | Van Huystee | A47C 9/02 |
| 2004/0099301 | A1 * | 5/2004 | Zhang | A47D 7/00 135/135 |
| 2004/0123383 | A1 * | 7/2004 | Nguyen | A47D 9/02 5/109 |
| 2011/0144416 | A1 * | 6/2011 | Waddell | A47D 9/02 600/26 |
| 2011/0230272 | A1 * | 9/2011 | Pyrce | A47D 13/10 472/119 |
| 2012/0264530 | A1 * | 10/2012 | Gilbert | A47D 13/105 472/118 |
| 2014/0287846 | A1 * | 9/2014 | Mountz | A47D 9/02 472/118 |
| 2015/0320233 | A1 * | 11/2015 | Cooper | A47D 1/0081 297/353 |
| 2016/0227939 | A1 * | 8/2016 | Tadipatri | A47D 9/005 |
| 2017/0208964 | A1 * | 7/2017 | Luginin | A47D 9/04 |
| 2019/0246806 | A1 * | 8/2019 | Beghtel | A47D 15/005 |
| 2020/0037782 | A1 * | 2/2020 | Malott | A47D 7/04 |

OTHER PUBLICATIONS

Gracobaby, "Graco Soothing System Glider", Sep. 3, 2014, YouTube, available at https://www.youtube.com/watch?v=p2zlpVb_5XE (Year: 2014).*

Growingyourbaby, "New! Graco Dream Glider Swing ABC Kids Expo 2016", Oct. 30, 2016, YouTube, available at https://www.youtube.com/watch?v=liKUrmplUqY (Year: 2016).*

* cited by examiner

1400

BABY SLEEPING APPARATUS

CROSS-REFERENCE TO RELATED APPLICATIONS

The current application claims priority to a provisional application 62/562,233 filed 5 on Sep. 22, 2017.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Field of the Invention

The present disclosure relates to baby bed.

Description of the Related Art

In the art of the present disclosure, there are various rocking beds available in the market. These conventional cradle beds allow access to a baby from two opposite sides since other two sides have pivoting points for cradle. Further, these beds do not come with mechanism to save a baby from crawling out of it which is very serious safety issue because every baby starts to crawl sooner or later. Moreover, in conventional beds, babies are tied with straps to the bed to prevent them from falling down.

Therefore, there is a need of a baby bed that allows parents to easily access baby from the bed with almost 3 sides being available to access baby from. Also, while a baby is sleeping in the bed, the bed should be secured so the baby cannot crawl out of it, and so forth. In addition, a bed must be able to secure a baby in a convenient way while allowing sufficient movement for the baby.

In the light of the above, there is a need to a baby bed that addresses limitations of conventional baby beds.

BRIEF SUMMARY OF THE INVENTION

The present disclosures teaches an improved sleeping apparatus that has safety enclosure to secure a baby inside a bed with walls that is stationary or in motion.

In another aspect of the present disclosure, the sleeping apparatus has a bed that swings or slides in relation to the frame.

In another aspect of the present disclosure, the sleeping apparatus has a bed that is rotatable along a horizontal axis and perpendicular to vertical axis which results in from side to side body motion of a subject sleeping inside bed to top to bottom of body motion similar to a garden swing motion.

In another aspect of the present disclosure, the sleeping apparatus has an electrical device that provides a swinging motion or a sliding motion.

In another aspect of the present disclosure, the sleeping apparatus can hold phone or tablet.

In another aspect of the present disclosure, the sleeping apparatus has an electrical circuit that generates various recorded or streaming sounds.

In another aspect of the present disclosure, the sleeping apparatus is controlled wirelessly.

In another aspect of the present disclosure, the sleeping apparatus has a bed that is made of fabric.

DESCRIPTION OF THE DRAWINGS for clearer understanding of the present disclosure, references are made to the following descriptions:

DETAILED DESCRIPTION OF THE INVENTION

Following description teaches a number of embodiments and applications of the present disclosure. The description makes references to the accompanying drawings that form a part hereof. It will be understood to a person ordinarily skilled in the art that drawings are for illustration purpose only and to explain the disclosure clearly. These drawings are not intended to limit the scope of the disclosure. It is to be understood that other embodiments may be utilized and changes may be made without departing from the scope of the present invention. The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
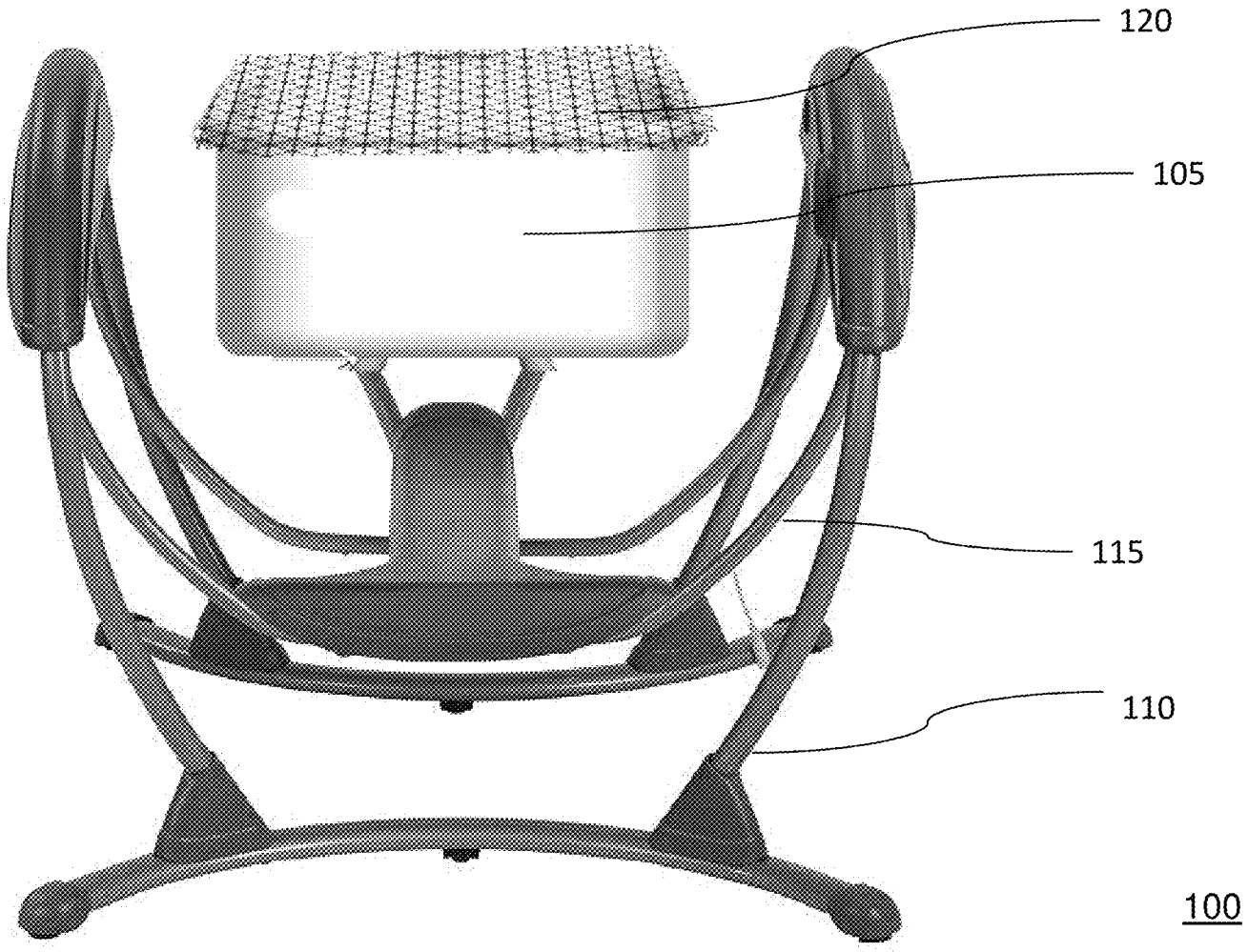
FIG. 1 is a front perspective view of a sleeping apparatus with a sliding bed, in an embodiment of the present disclosure.

FIG. 1 is a Front perspective view of a sleeping apparatus 100. The sleeping apparatus 100 has a bed 105, a safety enclosure 120 and a frame 110. The frame 110 provides structural strength to the sleeping apparatus 100. The frame 110 has the plurality of supports 115 such that the plurality of supports 115 re pivotally connected the frame 110. The plurality of supports 115 enables back and forth pivoting movement in relation to the frame 110. A bed 105 is pivotally connected to the plurality of supports 115. This overall structure allows the bed 105 slides back and forth in relation to the frame 110. In an embodiment of the present disclosure, the bed 105 is operationally connected to the frame 110. In yet another embodiment of the present disclosure, an electrical device can provide back and forth motion, side-ways motion or a combination motion to the bed 105 in relation to the frame 110. For example, the bed 105 can be motorized. In an embodiment of the present disclosure, the bed 105 is motorized and is controlled wirelessly through a smart phone, a mobile, a tablet, and so forth. The bed 105 has a sleeping area that is surrounded by walls. In an embodiment of the present disclosure, there is an upward slope near the head of a baby. It is described in further detail subsequently. In an embodiment of the present disclosure, the bed 105 has a base that is made of fabric. The fabric allows adjustment according to baby's shape and weight. In another embodiment of the present disclosure, a base of the bed 105 is fully removable. A baby can sleep in the bed 105 and the walls ensure that the baby does not fall down from the bed 105. The bed 105 is further enclosed by the safety enclosure 120. The safety enclosure 120 is described in details subsequently. Also, the sleeping apparatus 100 has an arrangement to hold phone or tablet. In an embodiment of the present disclosure, the sleeping apparatus 100 is motorized and has an electrical circuit that generates various recorded or streaming sounds. For example, music can be streamed from a website. In another example, the sleeping apparatus 100 can swing back and forth by an electrical motor operationally connected to the bed on the sleeping apparatus 100. Also the motor can be operated wirelessly through a phone or a tablet. In another embodiment of the present disclosure, the sleeping apparatus 100 has an electrical timer circuit to time various functions of the sleeping apparatus 100. For example, start and stop timing of streaming can be programmed on an app on a mobile phone. In another example, duration and speed of swing can be set through an app. It will be understood to a person ordinarily skilled in the art, several functions of the sleeping apparatus 100 can be wirelessly controlled.

Figure 2:
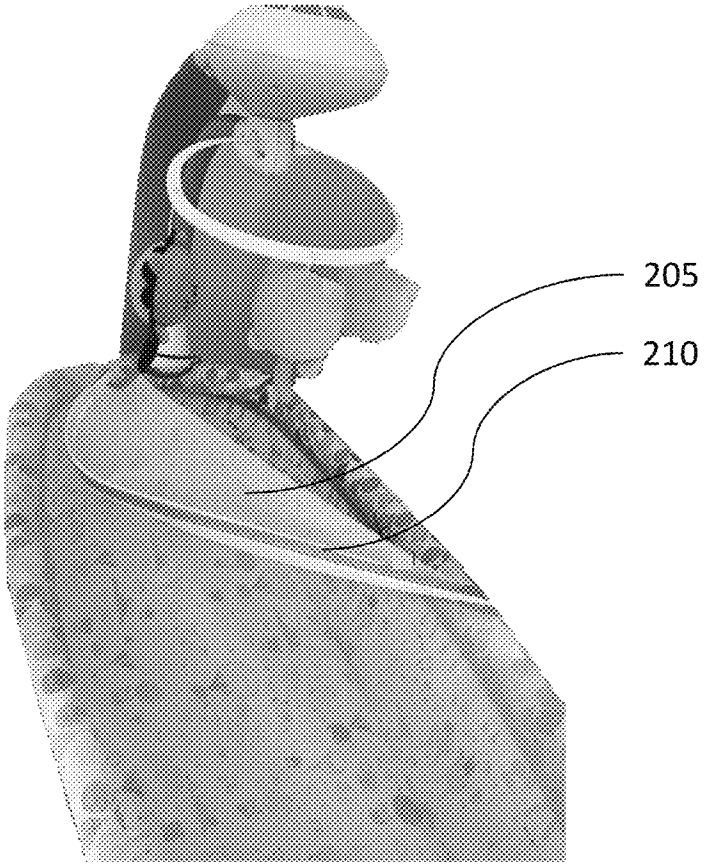
FIG. 2 is front angled view of a sleeping apparatus with partially open safety enclosure, in an embodiment of the present disclosure.

FIG. 2 is a sleeping apparatus with partially open safety enclosure 205, in an embodiment of the present disclosure. The safety enclosure 205 is a breathable enclosure such that the bed 105 becomes an enclosed breathable chamber after the safety enclosure 205 is securely closed. In an embodiment of the present disclosure, the safety enclosure 205 is partially open. In another embodiment of the present disclosure, the safety enclosure 205 is closed. This embodiment is shown in the FIG. 2. In yet another embodiment of the present disclosure, the safety enclosure 205 is fully removed. The safety enclosure 205 can be a mosquito net that is strong enough to secure baby inside the bed. The safety enclosure 205 can has a zipper 210 to close the safety enclosure 205 securely. It will be apparent to a person to ordinarily skilled in the art that toys can be attached to the sleeping apparatus 100. Also, the sleeping apparatus 100 can have a provision to secure phone.

In an embodiment of the present disclosure, the bed 105 is rotatable such that same angle is maintained with respect to horizontal plane but different angles with respect to the frame 100.

Figure 3:
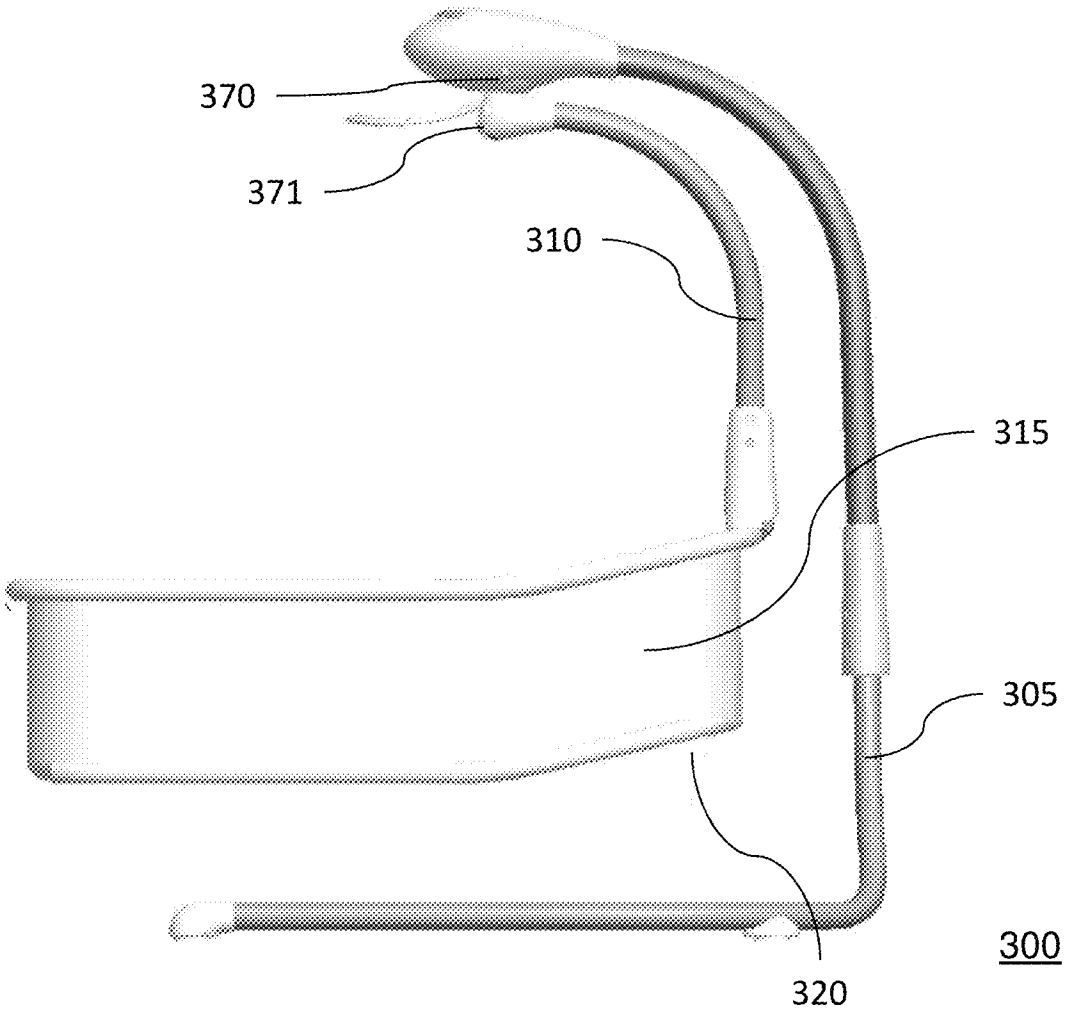
FIG. 3 is a right side view of a sleeping apparatus, in an embodiment of the present disclosure.

FIG. 3 is a right side view of a sleeping apparatus 300, in an embodiment of the present disclosure. The sleeping apparatus 300 is shown to include a frame 305, a first end of a single pivot-point 370, a second end of the single pivot-point 371, one or more swing supports 310 and a bed 315. The one or more swing supports 310 are pivotally connected to the frame 305. The bed 315 is mechanically coupled to the one or more supports 310. In addition, the sleeping apparatus 300 includes the safety enclosure 205 (not shown). In an embodiment of the present disclosure, there is an upward slope 320 near the head of a baby.

Figure 4:
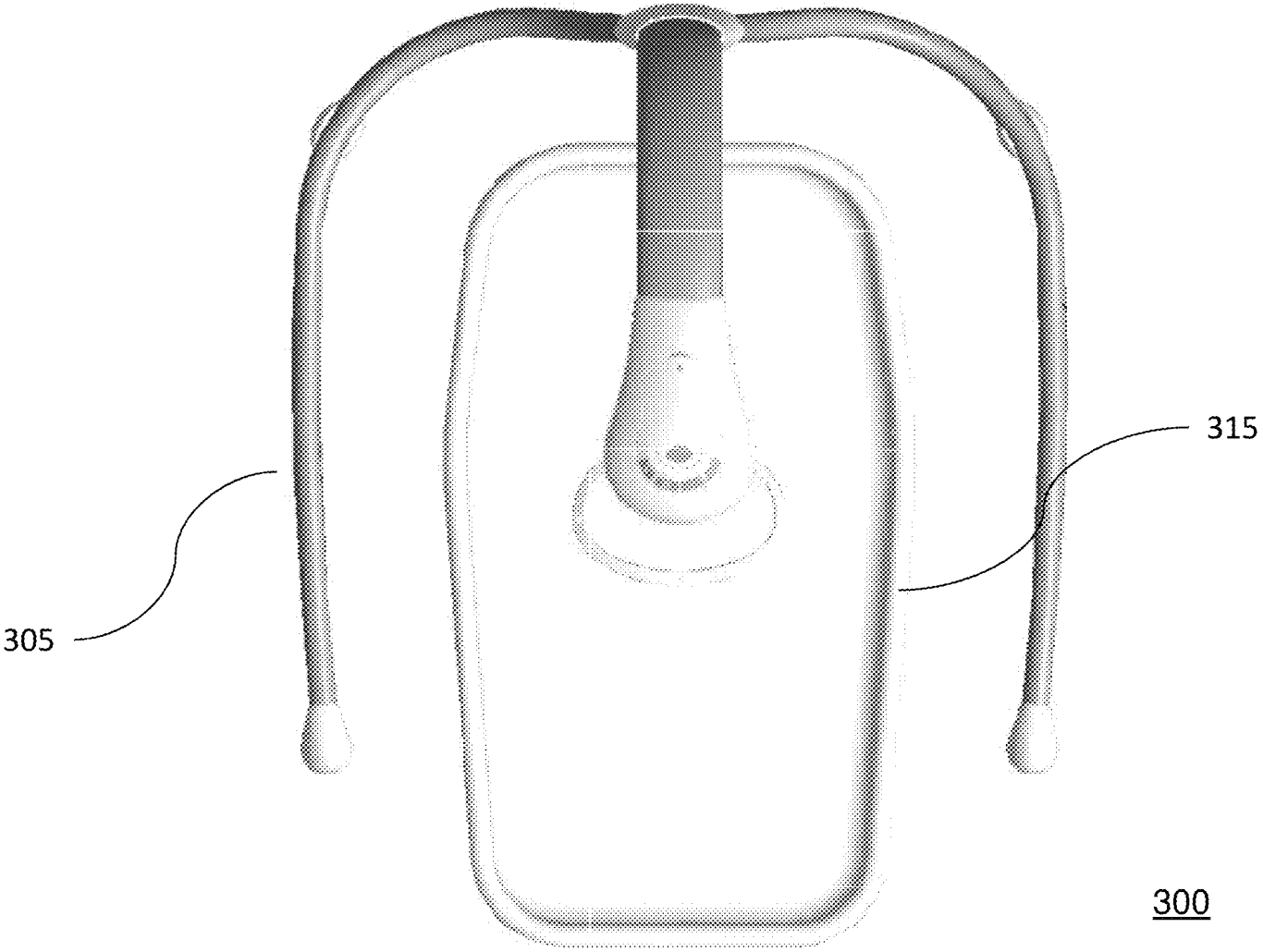
FIG. 4 is a top view of a sleeping apparatus without a safety enclosure present, in another embodiment of the present disclosure.

FIG. 4 is a top view of the sleeping apparatus 300, in an embodiment of the present disclosure. The sleeping apparatus 300 includes the safety enclosure 205, however, it is not shown in the FIG. 4.

Figure 5:
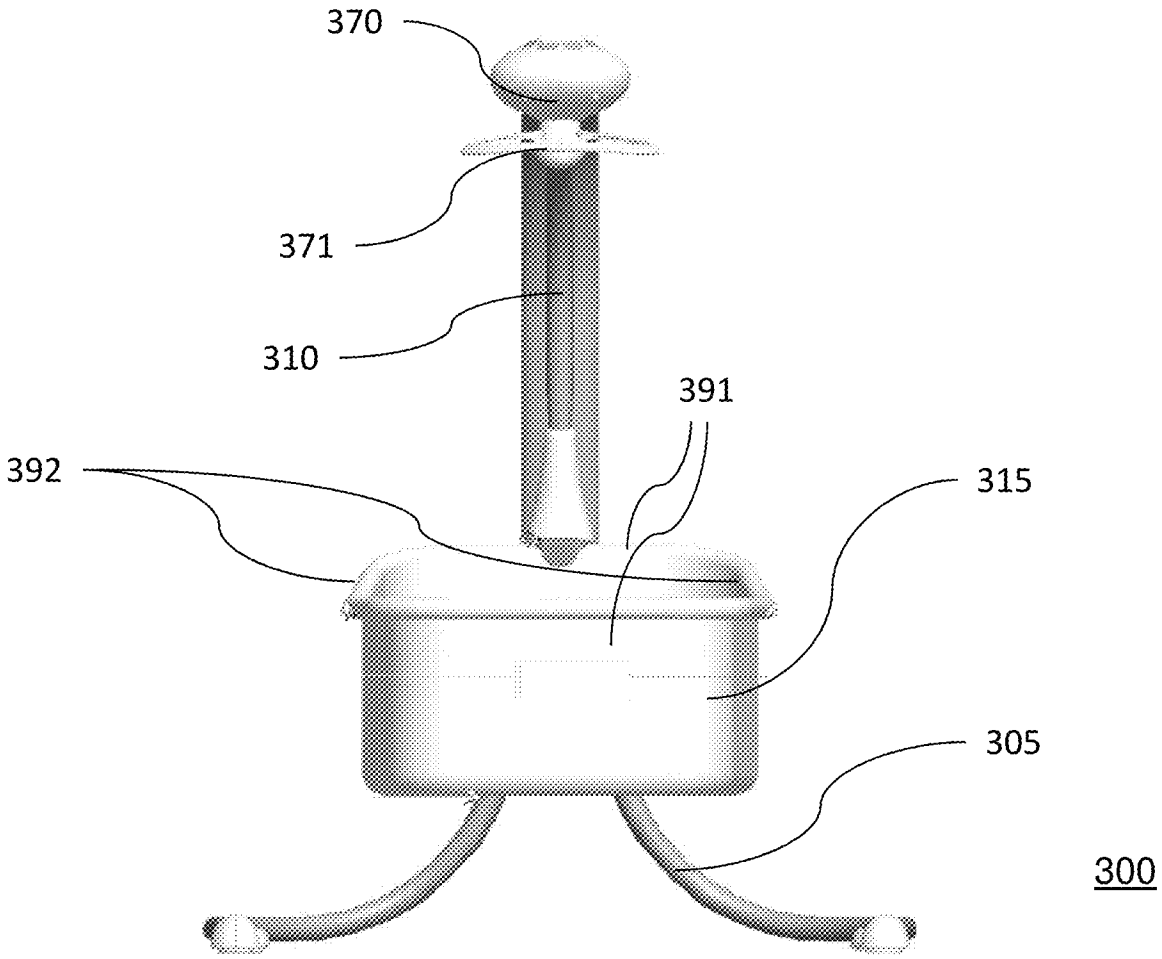
FIG. 5 is a front view of a sleeping apparatus, in another embodiment of the present disclosure.

FIG. 5 is a front view of the sleeping apparatus 300, in another embodiment of the present disclosure. FIG. 5 illustrates bed 315 comprising a first pair of opposing walls 391 and a second pair of opposing walls 392; wherein the second pair of opposing walls are longer in length than the first pair of opposing walls of the bed 315.

Figure 6:
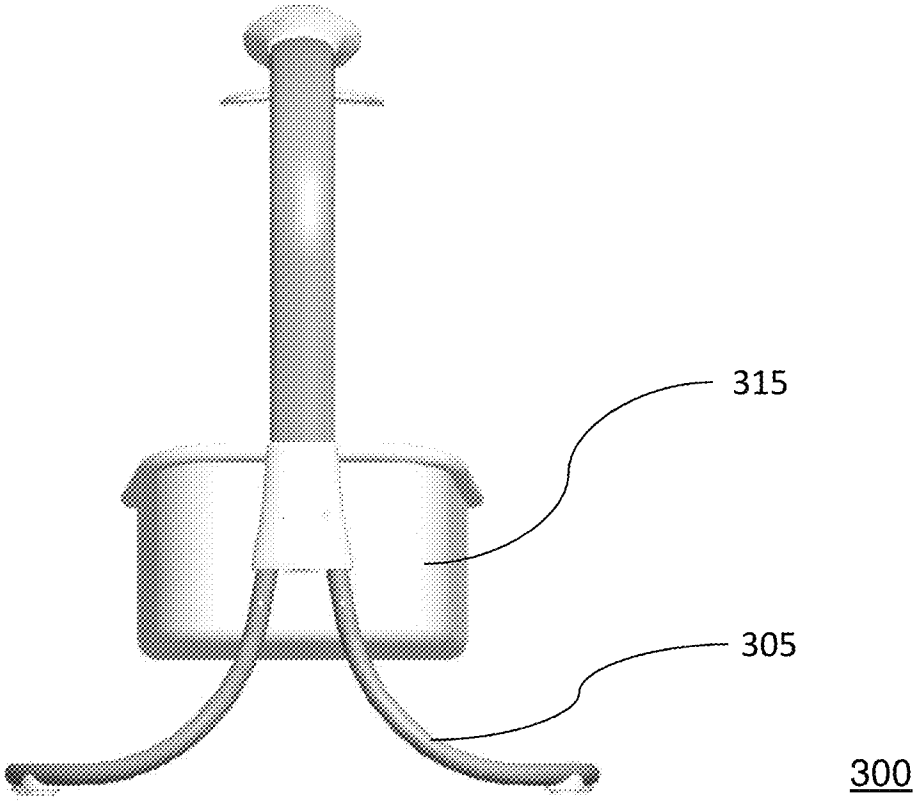
FIG. 6 is a rear view of a sleeping apparatus, in another embodiment of the present disclosure.

FIG. 6 is a rear view of the sleeping apparatus 300, in another embodiment of the present disclosure.

Figure 7:
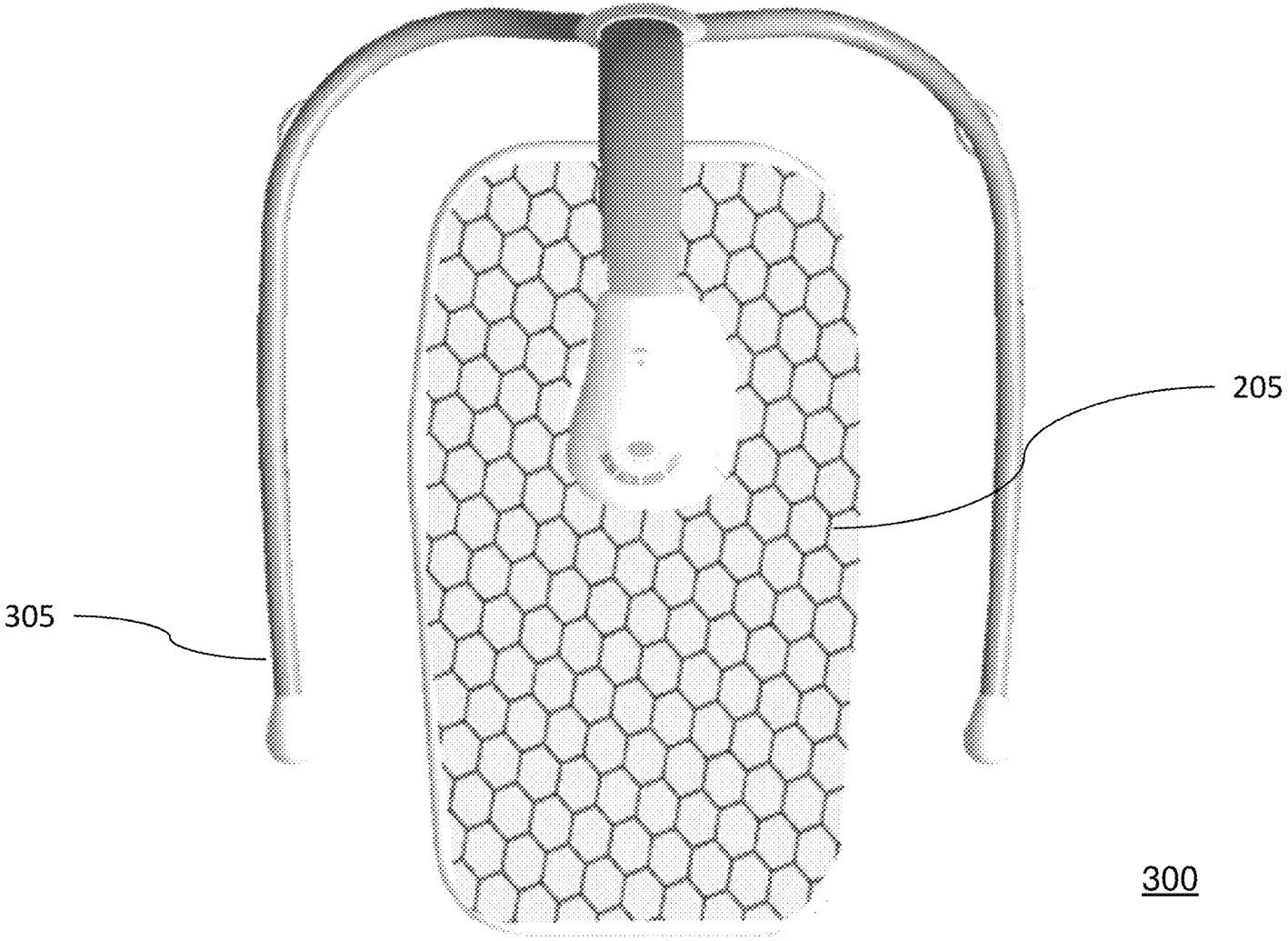
FIG. 7 is a top view of a sleeping apparatus with a safety enclosure, in another embodiment of the present disclosure.

FIG. 7 is a top view of the sleeping apparatus 300 with the safety enclosure 205, in another embodiment of the present disclosure. It should be noted that Figs. are shown for the purpose of illustration only; an actual sleeping apparatus may look considerably different without deviating from the scope of the invention.

Figure 8:
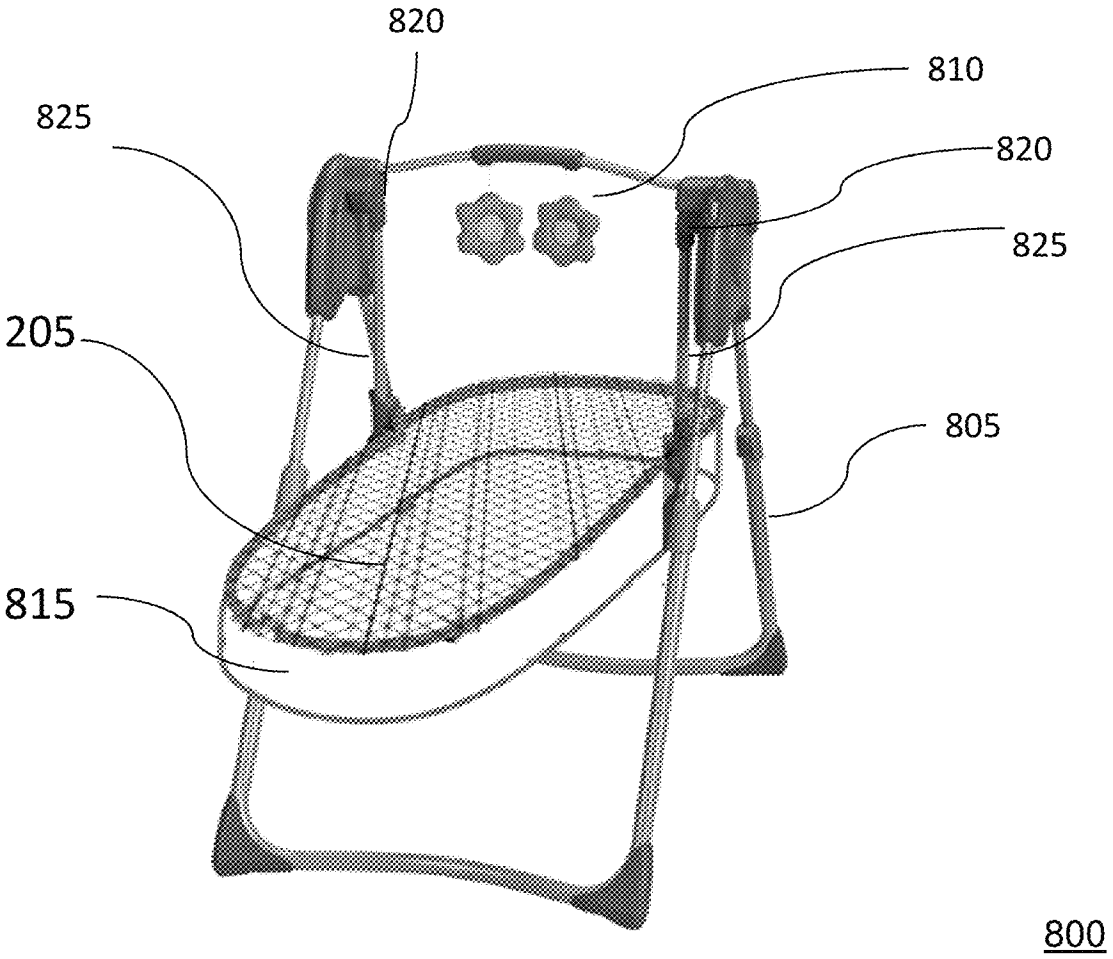
FIG. 8 is a angled view of a sleeping apparatus with two pivoting swing supports, in another embodiment of the present disclosure.

FIG. 8 is a sleeping apparatus 800 with the safety enclosure 205, in yet another embodiment of the present disclosure. The sleeping apparatus 800 includes a frame 805, toys 810, a bed 815 and a safety enclosure 205. It will be understood to a person ordinarily skilled in the art that the frame 805 can be of different shapes and configurations. The bed 815 is shown to be transparent for the sake of clarity. The sleeping apparatus 800 has bed 815 pivotally connected to frame 805 with two supports 825 each support connected to one of two distinct pivot points 820.

Figure 9:
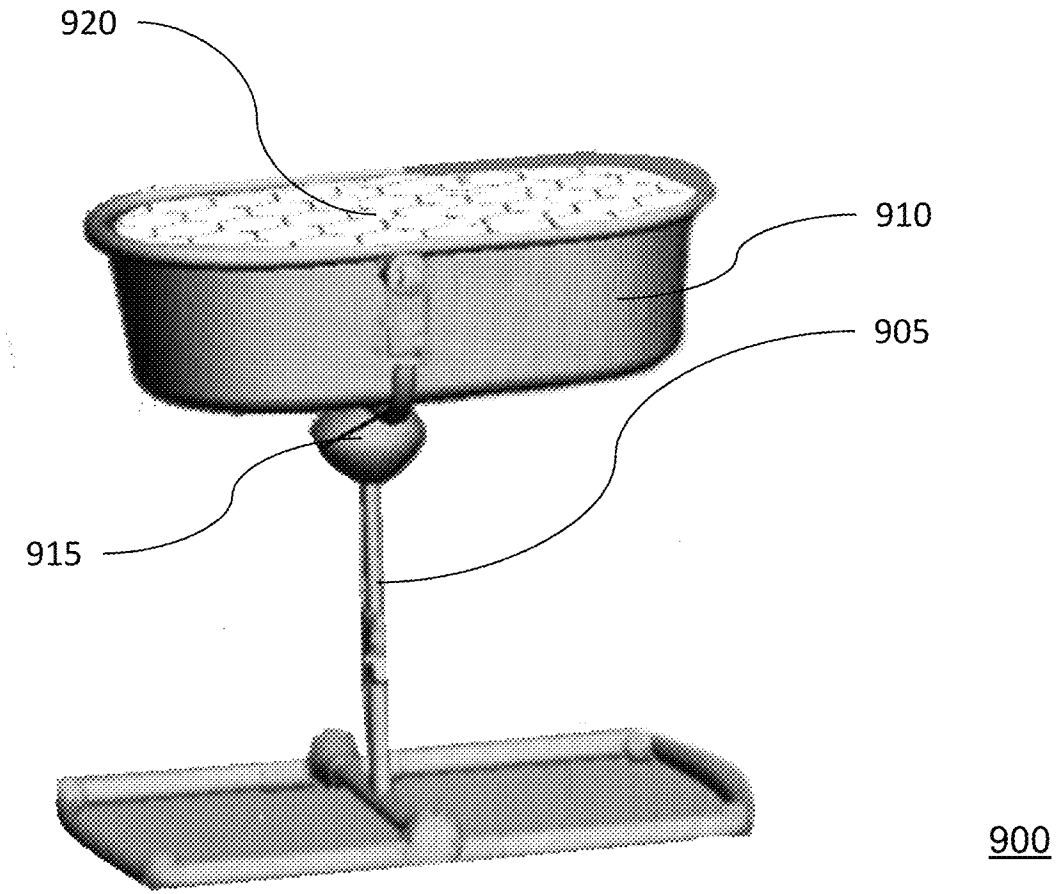
FIG. 9 is a angled view of a sleeping apparatus with a side to side sliding swing support swing function, in another embodiment of the present disclosure.

FIG. 9 is a sleeping apparatus 900, in yet another embodiment of the present disclosure. The sleeping apparatus 900 in includes a frame 905, a bed 910, a motion frame 915 and a safety enclosure 920. The bed 910 can be pivoted on the pivot 915 that allows rocking motion of the bed 910. This rocking motion is motorized and can also be controlled wirelessly through a mobile phone or a tablet. In another embodiment of apparatus 900 the bed 910 can be designed to slide at pivot point 915 that allows side by side swinging motion of the bed 910. This rocking motion is motorized and can also be controlled wirelessly through a mobile phone or a tablet.

Figure 10:
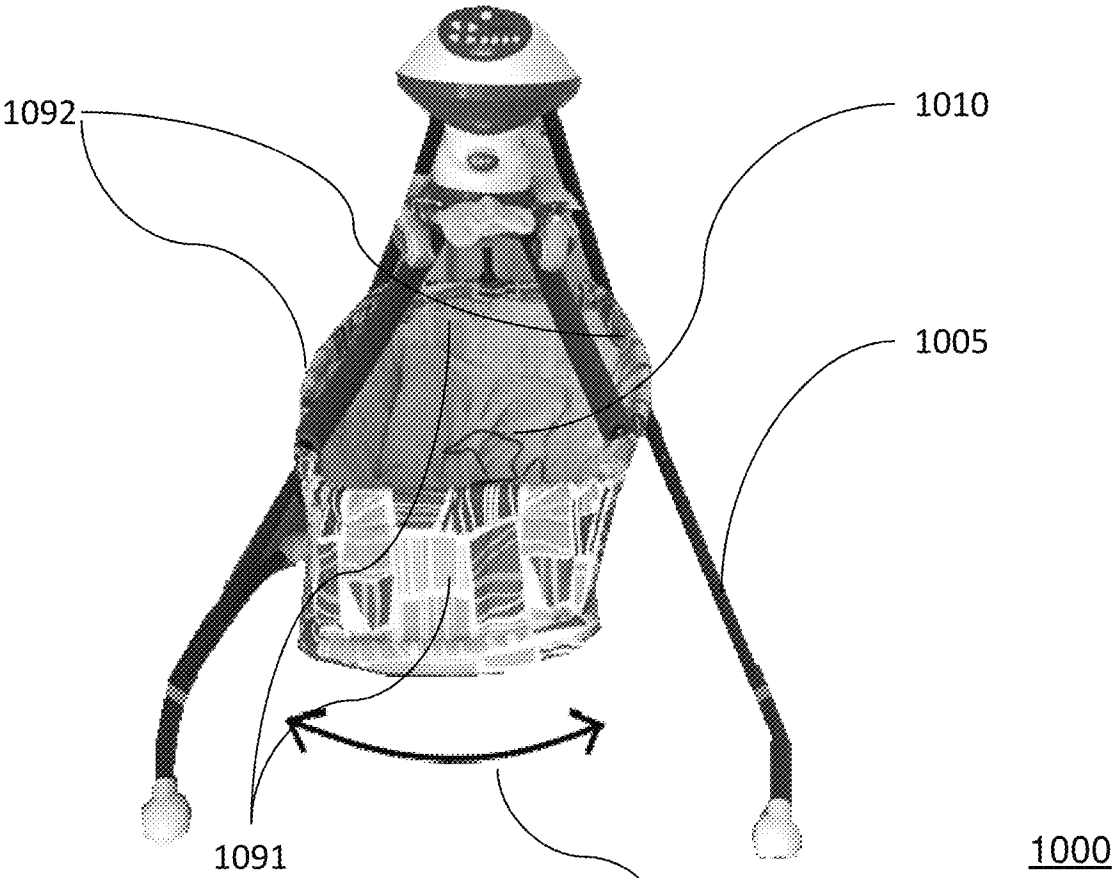
FIG. 10 is a side view of a sleeping apparatus with a ninety degree rotate option for side to side swinging operation, in an embodiment of the present disclosure.

FIG. 10 is a sleeping apparatus 1000, in yet another embodiment of the present disclosure. The sleeping apparatus 1000 in includes a frame 1005 and a bed 1010. The bed 1010 hangs on the frame 1005 such that the bed 1010 can swing left-right and a subject inside will feel body motion in side to side direction 1015 in a way whole body swings from side to side being inside bed.

Figure 11:
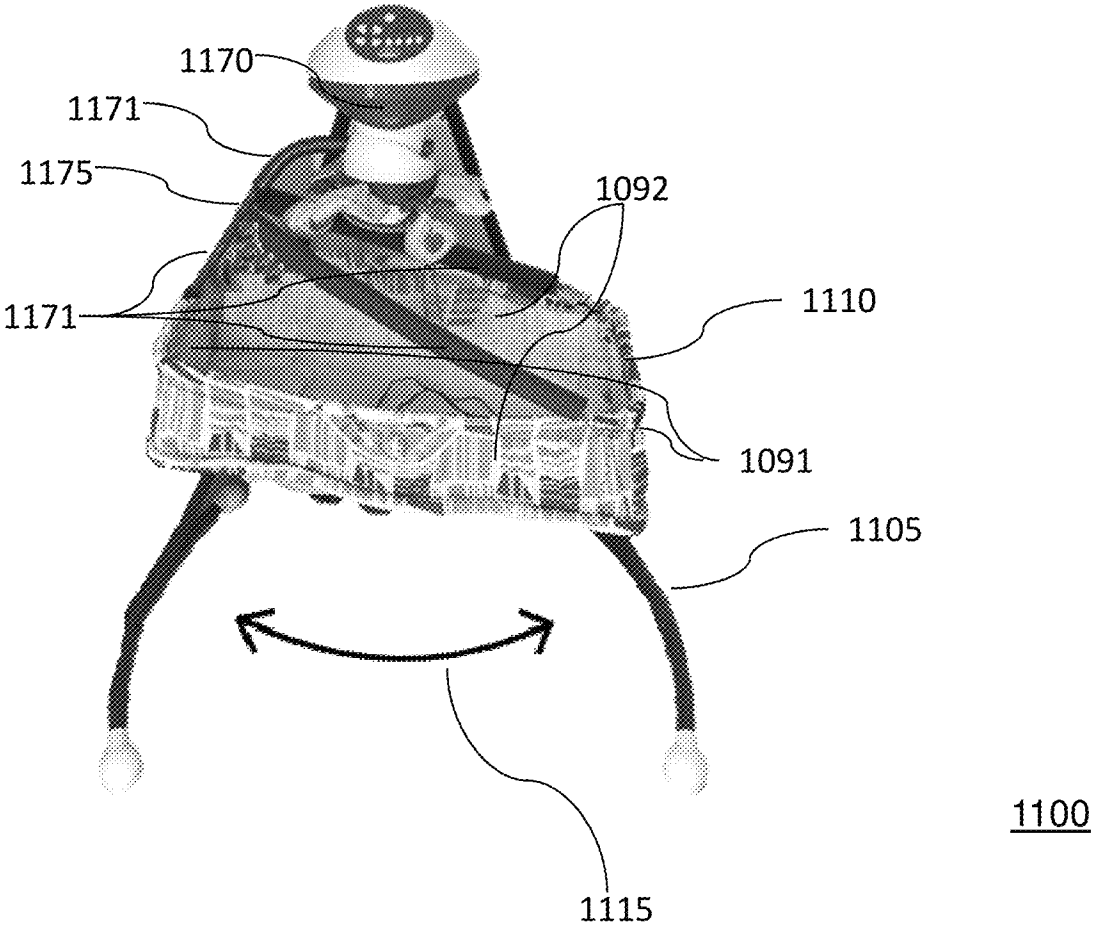
FIG. 11 is a side view of a sleeping apparatus with a ninety degree rotate option for garden swing like motion from head to toe motion, in another embodiment of the present disclosure.

FIG. 11 is a sleeping apparatus 1100, in yet another embodiment of the present disclosure. The sleeping apparatus 1100 in includes a frame 1105 and a bed 1110. The bed 1110 hangs on the frame 1105 such that the bed 1010 can be rotated along a horizontal axis and perpendicular to vertical axis which results in from side to side body motion 1115 of a subject sleeping inside of bed shown in FIG. 11 to top to bottom of body motion similar to a garden swing motion where subject's head and toe swings up and down one by one. FIG. 11 illustrates a first end of the single pivot-point 1170 which is directly connected to the frame 1105 and a second end of the single pivot-point 1171. Three swing supports 1171 are connected to the second end of the single pivot-point 1171 at junction 1175. Another end of one of the three swing supports 1171 is directly connected to one of the two first pair of opposing walls and each of the rest two of the at least three swing supports 1171 is connected to respective one of the second pair of opposing walls. The second pair of opposing walls is longer in length than the first pair of opposing walls.

Swinging motion 1115 shown in FIG. 11 will keep a top of the first pair of opposing walls 1091 substantially parallel or substantially at a same angle to the horizontal plane upon which the base 1105 is placed. The second pair of opposing walls 1092 will constantly at different angle to the horizontal plane while the bed 1110 is in a swinging motion.

Figure 12:
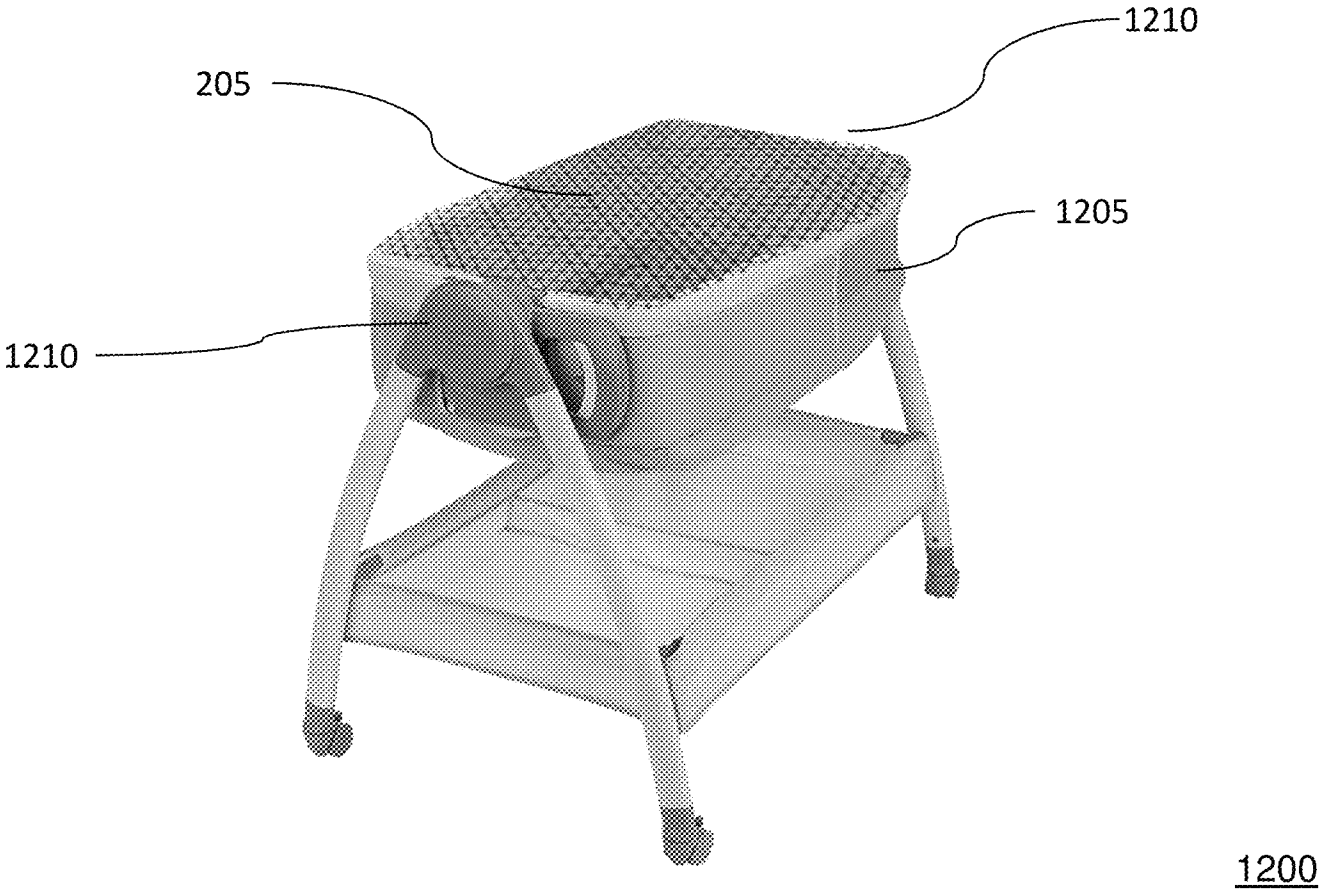
FIG. 12 is a sleeping apparatus 1200, in yet another embodiment of the present disclosure.

Swinging motion 1015 of FIG. 10 will keep a top of the second pair of opposing walls 1092 substantially parallel or substantially at a same angle to the horizontal plane upon which the base 1105 is placed. The first pair of opposing walls 1091 will constantly at a different angle to the horizontal plane while the bed 1110 is in a swinging motion.
a sideways swinging motion that keeps a top of the second pair of opposing walls substantially parallel or substantially at a same angle to the horizontal plane of the ground FIG. 12 is a sleeping apparatus 1200, in yet another embodiment of the present disclosure. The sleeping apparatus 1200 has a bed 1205 with a safety enclosure 205 to secure a baby inside and provide protection against from falling out of bed 1205 and from mosquito at the same time. In an embodiment of the present disclosure, the bed 1205 is stationary. In another embodiment of the present disclosure, the bed 1205 swings from its two distinct pivot points 1210. This present a sleeping apparatus allows 360 degree of access to the bed 1205 since the entire top of bed 1205 exposed and accessible entirely from top once a safety enclosure 205 is partially or fully removed. Also, the sleeping apparatus 1200 has an arrangement to hold phone or tablet. In an embodiment of the present disclosure, the sleeping apparatus 1200 is motorized for swinging motion and can have an electrical circuit that generates various recorded or streaming sounds. For example, music can be streamed from a website. In another example, the sleeping apparatus 1200 can swing back and forth by an electrical motor operationally connected to the bed on the sleeping apparatus 1200. Also the motor can be operated wirelessly through a phone or a tablet. In another embodiment of the present disclosure, the sleeping apparatus 1200 has an electrical timer circuit to time various functions of the sleeping apparatus 1200. For example, start and stop timing of streaming can be programmed on an app on a mobile phone. In another example, duration and speed of swing can be set through an app. It will be understood to a person ordinarily skilled in the art, several functions of the sleeping apparatus 1200 can be wirelessly controlled.

Figure 13:
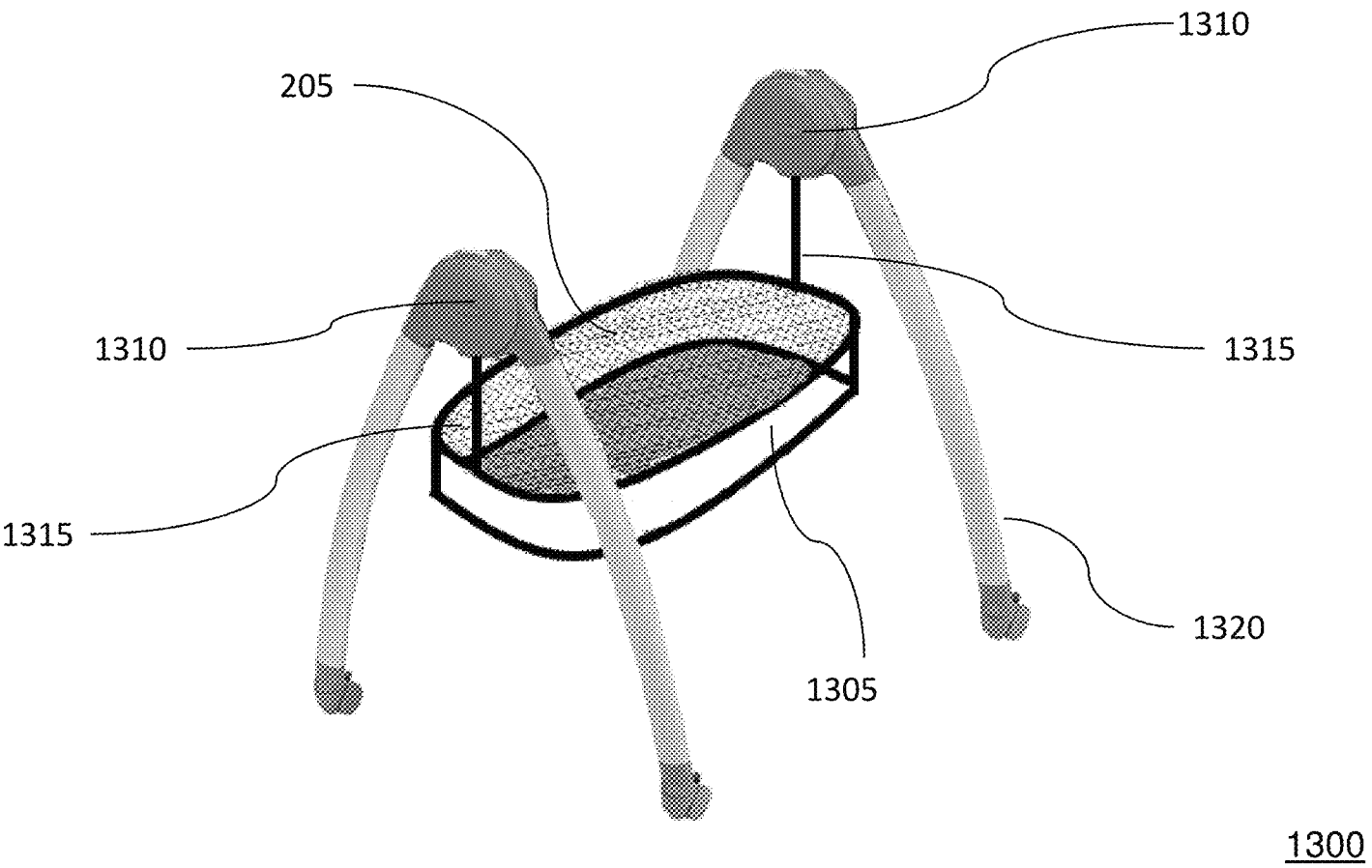
FIG. 13 is a sleeping apparatus 1300, in yet another embodiment of the present disclosure with suspended pivotal swing supports.

FIG. 13 is a sleeping apparatus 1300, in yet another embodiment of the present disclosure. The sleeping apparatus 1300 has a bed 1305 with a safety enclosure 205 to secure a baby inside and provide protection against from falling out of bed 1305 and from mosquito at the same time. In an embodiment of the present disclosure, the bed 1305 is stationary and suspended with help of a pair of swing support 1325 which can pivotally connected to frame 1320. In another embodiment of the present disclosure, the bed 1305 swings from its two distinct pivot points 1320. This present a sleeping apparatus allows more degree of access to the bed 1305 since there isn't any frame or bar at the top of the bed like conventional cradle have. Also, the sleeping apparatus 1300 has an arrangement to hold phone or tablet. In an embodiment of the present disclosure, the sleeping apparatus 1300 is motorized for swinging motion and can have an electrical circuit that generates various recorded or streaming sounds. For example, music can be streamed from a website. In another example, the sleeping apparatus 1300 can swing back and forth by an electrical motor operationally connected to the bed on the sleeping apparatus 1300. Also the motor can be operated wirelessly through a phone or a tablet. In another embodiment of the present disclosure, the sleeping apparatus 1300 has an electrical timer circuit to time various functions of the sleeping apparatus 1300. For example, start and stop timing of streaming can be programmed on an app on a mobile phone. In another example, duration and speed of swing can be set through an app. It will be understood to a person ordinarily skilled in the art, several functions of the sleeping apparatus 1300 can be wirelessly controlled.

Figure 14:
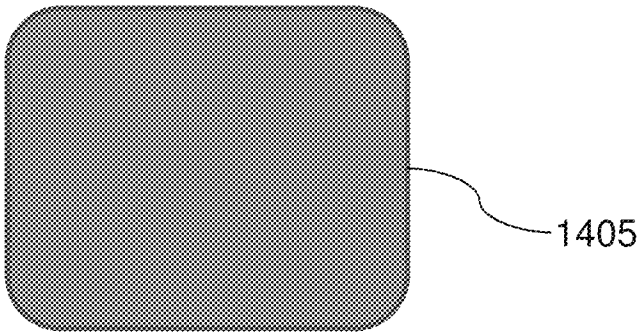
FIG. 14 is a swinging angle sensor 1400, in yet another embodiment of the present discloser with a swinging angle sensor.

FIG. 14 is a swinging angle sensor 1405, wherein the apparatus has a swinging angle sensor which can help adjust both side end swinging angles of said bed.

The invention claimed is:

1. A baby swing apparatus comprising:

a frame, a swing support, a single pivot-point, and a bed;

wherein the frame includes a base which is configured to stay stationary relative to the ground and the frame is directly connected to a first end of the single pivot-point;

wherein a top end of the swing support is directly connected to a second end of the single pivot-point;

the bed comprising a substantially vertical wall peripheral to a sleeping area, such that the sleeping area is surrounded by the substantially vertical wall, wherein the substantially vertical wall is connected to all four sides of the sleeping area at a bottom thereof, wherein the substantially vertical wall has a first pair of opposing walls and a second pair of opposing walls longer in length than the first pair, wherein a bottom end of the swing support is directly connected to only one of the first pair of opposing walls;

wherein the bed is connected to the frame via only the one of the first pair of opposing walls connected to the swing support;

wherein an electrical device is operationally connected between the frame and the swing support, and is configured to provide two-directional pendulum swinging motion to the bed in relation to the frame;

wherein the bed is connected to the frame in an orientation such that the frame is present on a top side, a bottom side and a rear side of the bed, and absent on a left side, a right side and a front side of the bed;

wherein the sleeping area is elevated towards the one of the first pair of opposing walls, wherein elevating of the sleeping area is configured to elevate a baby's head to provide comfortable sleeping position by keeping the baby's head elevated compared to rest of the baby's body.

2. The baby swing apparatus as defined in claim 1, wherein said bed further comprises a safety enclosure on top of the substantially vertical walls, wherein said safety enclosure is a breathable enclosure for an opening of said bed, wherein said bed with the substantially vertical wall becomes a breathable enclosed chamber once said safety enclosure is secured to said bed.

3. The baby swing apparatus as defined in claim 1, wherein said sleeping area is made from a fabric, wherein the sleeping area is removable from said bed.

4. The baby swing apparatus as defined in claim 1, wherein toys for child's entertainment are attached to the apparatus.

5. The baby swing apparatus as defined in claim 1, further comprising a structure to hold a phone or a tablet.

6. The baby swing apparatus as defined in claim 1, further comprising an electrical circuit, wherein the electrical circuit generates various recorded or streaming sound waves.

7. The baby swing apparatus as defined in claim 1, further comprising an electrical timer, wherein the electrical timer circuit is integrated to set time for various functions of the apparatus.

8. The baby swing apparatus as defined in claim 1, further comprising a swinging angle sensor, wherein the swinging angle sensor configured to adjust swinging angles of said bed.

9. A baby swing apparatus comprising:

a frame, a swing support, a single pivot-point and a bed;

wherein said frame includes a base which is configured to stay stationary relative to the ground and the frame is directly connected to a first end of the single pivot-point;

wherein a top end of the swing support is directly connected to a second end of the single pivot-point;

the bed comprising a substantially vertical wall peripheral to a sleeping area, such that the sleeping area is surrounded by the substantially vertical wall, wherein the substantially vertical wall is connected to all sides of the sleeping area at a bottom thereof, wherein the substantially vertical wall has a first pair of opposing walls and a second pair of opposing walls longer in length than the first pair, wherein bottom end the swing support is directly connected to at least one of the second pair of opposing walls;

wherein the at least one of the second pair of opposing walls is connected to the single pivot-point only via the swing support; wherein an electrical device is operationally connected between the frame and the swing support, and is configured to provide two-directional pendulum swinging motion to the bed in relation to the frame;

wherein the bed is connected to the frame in an orientation such that the frame is present on a top side, a bottom side and a rear side of the bed, and absent on a left side, a right side and a front side of the bed;

wherein the bed is connected to the frame only via the single pivot-point;

wherein the sleeping area is elevated towards one of the first pair of opposing walls, wherein elevating of the sleeping area is configured to elevate a baby's head to provide comfortable sleeping position by keeping the baby's head elevated compared to rest of the baby's body.

10. The baby swing apparatus as defined in claim 9, wherein said sleeping area is made from fabric, wherein said fabric is removable from said bed.

11. The baby swing apparatus as defined in claim 9, wherein toys for child's entertainment are attached to the apparatus.

12. The baby swing apparatus as defined in claim 9, further comprising an electrical circuit, wherein the electrical circuit generates various recorded or streaming sound waves.

13. The baby swing apparatus as defined in claim 9, further comprising an electrical timer circuit, wherein the electrical timer circuit is integrated to time various functions of the apparatus.

14. The baby swing apparatus as defined in claim 9, further comprising a swinging angle sensor configured to adjust swinging angles of said bed.

15. The baby swing apparatus as defined in claim 9, wherein said bed further comprises a safety enclosure on top of said substantially vertical walls, wherein said safety enclosure is a breathable enclosure for an opening of said bed, wherein said bed with the substantially vertical wall becomes a breathable enclosed chamber once said safety enclosure is secured to said bed.

16. A baby swing apparatus comprising:

a frame, a swing support, a single pivot-point, and a bed;

wherein the frame includes a base which is configured to stay stationary relative to the ground and the frame is directly connected to a first end of the single pivot-point;

wherein a top end of the swing support is directly connected to a second end of the single pivot-point;

the bed comprising a substantially vertical wall peripheral to a sleeping area, such that the sleeping area is surrounded by the substantially vertical wall, wherein the substantially vertical wall is connected to all four sides of the sleeping area at a bottom thereof, wherein the substantially vertical wall has a first pair of opposing walls and a second pair of opposing walls longer in length than the first pair, wherein a bottom end of the one swing support is directly connected to one of the first pair of opposing walls and at least one of the second pair of opposing walls;

wherein the only one of the first pair of opposing walls and the at least one of the second pair of opposing walls are connected only to the single pivot-point via at least one of the swing support;

wherein an electrical device is operationally connected between the frame and the swing support, and is configured to provide two-directional pendulum swinging motion to the bed in relation to the frame;

wherein the bed is connected to the frame in an orientation such that the frame is present on a top side, a bottom side and a rear side of the bed, and absent on a left side, a right side and a front side of the bed; wherein the bed is connected to the frame only via the single pivot-point;

wherein the sleeping area is elevated towards the one of the first pair of opposing walls, wherein elevating of the sleeping area is configured to elevate a baby's head to provide comfortable sleeping position by keeping the baby's head elevated compared to rest of the baby's body.

17. The baby swing apparatus as defined in claim 16, wherein said bed further comprises a safety enclosure on top of the substantially vertical wall, wherein said safety enclosure is a breathable enclosure for an opening of said bed, wherein said bed with the substantially vertical wall becomes a breathable enclosed chamber once said safety enclosure is secured to said bed.

18. The baby swing apparatus as defined in claim 16, wherein said sleeping area is made from fabric, wherein said fabric is removable from said bed.

19. The baby swing apparatus as defined in claim 16, wherein toys for child's entertainment are attached to the apparatus.

20. The baby swing apparatus as defined in claim 16, further comprising an electrical circuit, wherein the electrical circuit generates various recorded or streaming sound waves.

21. The baby swing apparatus as defined in claim 16, further comprising an electrical timer circuit, wherein the electrical timer circuit is integrated to time various functions of the apparatus.

22. The baby swing apparatus as defined in claim 16, further comprising a swinging angle sensor configured to adjust swinging angles of said bed.

* * * * *